US012649978B2

(12) United States Patent
Song et al.

(10) Patent No.: US 12,649,978 B2
(45) Date of Patent: Jun. 9, 2026

(54) ELECTRONIC DEVICE AND METHOD FOR MANUFACTURING HOUSING OF ELECTRONIC DEVICE

(71) Applicant: Samsung Electronics Co., Ltd., Gyeonggi-do (KR)

(72) Inventors: Kyunghwan Song, Gyeonggi-do (KR); Goeun Kim, Gyeonggi-do (KR); Inkyu Kim, Gyeonggi-do (KR); Hyunsoo Kim, Gyeonggi-do (KR); Hyesun Park, Gyeonggi-do (KR); Heesung Lee, Gyeonggi-do (KR); Youngjun Heo, Gyeonggi-do (KR); Kyungtae Kim, Gyeonggi-do (KR); Hyunsuk Choi, Gyeonggi-do (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 710 days.

(21) Appl. No.: 17/952,447

(22) Filed: Sep. 26, 2022

(65) Prior Publication Data

US 2023/0295826 A1 Sep. 21, 2023

Related U.S. Application Data

(63) Continuation of application No. PCT/KR2022/014382, filed on Sep. 26, 2022.

(30) Foreign Application Priority Data

Sep. 24, 2021 (KR) ..... 10-2021-0126505

(51) Int. Cl.

| | |
|---|---|
| ***C25D 11/14*** | (2006.01) |
| ***C25D 1/16*** | (2006.01) |
| ***C25D 11/24*** | (2006.01) |

(52) U.S. Cl.
CPC ..... *C25D 11/14* (2013.01); *C25D 1/16* (2013.01); *C25D 11/246* (2013.01)

(58) Field of Classification Search
CPC ..... C25D 11/14
(Continued)

(56) References Cited

U.S. PATENT DOCUMENTS

2007/0028402 A1 2/2007 Matsuoka
2011/0165391 A1 7/2011 Yamaguchi
(Continued)

FOREIGN PATENT DOCUMENTS

CN 104174576 A 12/2014
CN 107151811 A 9/2017
(Continued)

OTHER PUBLICATIONS

Runge, "Understanding the Anodic Oxide Finish: The First Commercially available Nanoscale Coating," Finishing and Coating, Aug. 23, 2022, URL: <https://finishingandcoating.com/index.php/anodizingcat/1243-understanding-the-anodic-oxide-finish-the-first-commercially-available-nanoscale-coating>, pp. 1-27 (Year: 2022).*
(Continued)

*Primary Examiner* — Katherine A Christy
(74) *Attorney, Agent, or Firm* — CANTOR COLBURN LLP

(57) ABSTRACT

An electronic device includes a housing that is at least partially formed of an electrically conductive material. A surface of the conductive material has an oxide film layer including a plurality of cavities. The plurality of cavities are colored in a first color and a second color, and the two colors are mixed when the second color is deposited on the first color. A method of manufacturing the housing includes
(Continued)

anodizing the conductive material to form the oxide film layer having the cavities and coloring the cavities with the first and second colors.

10 Claims, 14 Drawing Sheets

(58) Field of Classification Search
USPC ..... 428/469
See application file for complete search history.

(56) References Cited

U.S. PATENT DOCUMENTS

| | | | |
|---|---|---|---|
| 2014/0346049 | A1 | 11/2014 | Khosla |
| 2014/0349031 | A1 | 11/2014 | Nakamura et al. |
| 2017/0013735 | A1 | 1/2017 | Choi et al. |
| 2017/0088968 | A1 | 3/2017 | Curran et al. |
| 2021/0130974 | A1 | 5/2021 | Kim et al. |

FOREIGN PATENT DOCUMENTS

| | | | |
|---|---|---|---|
| CN | 107236980 | A | 10/2017 |
| JP | 10-330994 | A | 12/1998 |
| JP | 11-236697 | A | 8/1999 |
| JP | 2007-39757 | A | 2/2007 |
| JP | 2012-211361 | A | 11/2012 |
| JP | 2015-217565 | A | 12/2015 |
| KR | 10-2010-0014027 | A | 2/2010 |
| KR | 10-2017-0006709 | A | 1/2017 |
| KR | 10-2018-0088157 | A | 8/2018 |

OTHER PUBLICATIONS

International Search Report dated Jan. 5, 2023.

* cited by examiner

ELECTRONIC DEVICE AND METHOD FOR MANUFACTURING HOUSING OF ELECTRONIC DEVICE

CROSS-REFERENCE TO RELATED APPLICATION(S)

This application is a continuation of International Application No. PCT/KR2022/014382, which was filed on Sep. 26, 2022, and claims priority to Korean Patent Application No. 10-2021-0126505, filed on Sep. 24, 2021, in the Korean Intellectual Property Office, the disclosure of which are incorporated by reference herein their entirety.

BACKGROUND

Technical Field

Various embodiments of the disclosure relate to an electronic device and a housing structure of the electronic device.

Background Art

Advancing information communication technology and semiconductor technology have accelerated the spread and use of various electronic devices. In particular, recently, portable electronic devices capable of wireless communication are being developed. Further, electronic devices may output stored information as sound or images. As these electronic devices become highly integrated, and high-speed, high-volume wireless communication becomes commonplace, the electronic devices, such as mobile communication terminals, are recently being equipped with various functions. For example, one such electronic device may come with the integrated functionality, including features for entertainment, such as playing video games, features for multimedia, such as replaying music/videos, communication and security functions for mobile banking, and scheduling or e-wallet functions. Such electronic devices have become compact enough for users to conveniently carry.

There is an ongoing research effort to provide a better aesthetic look to an electronic device while protecting various circuit devices in the electronic device by produce the housing of the electronic device using metal.

SUMMARY

Aluminum can be used as the exterior material of a portable electronic device. To use aluminum as the exterior material of the electronic device, cutting, injection, and surface treatment of the aluminum, as representative processes, may be performed. For example, cutting is a process of forming a metallic exterior material into a desired shape using computerized numerical control (CNC), diamond cutting, and polishing machines. Injection is a forming process of injecting a synthetic resin melted at high temperature into a metallic exterior material component prepared in a mold and bonding the resin and metal. For example, as surface treatment, anodizing may be used. Anodizing is a process for treating the surface of a metal using an oxide film that is formed by oxidizing the metal (e.g., aluminum) with oxygen while conducting electricity through a positive electrode. Anodizing is widely used due to its capability of hardening the surface, providing high corrosion resistance, and easier coloring.

Demand for housing design for implementing various shapes or colors to provide better aesthetic appearance of the electronic device is increasing.

Conventional exterior material processing is incapable of implementing two or more colors in one housing and, even if possible, involves more processing steps, complicating the manufacture of the materials. For example, in implementing two or more colors in one housing, a film may first need to be formed by first anodizing to implement a first color, coloring is performed on the first color, and sealing is performed thereon. To implement a second color, the section requiring coloring in the different color is cut or polished to remove the first oxide film, and another film is formed by second anodizing, and the second color is subjected to coloring. As another example, first anodizing, first coloring, and sealing may be performed after partial masking on the housing. After removing the masking, second anodizing is performed to form the second oxide film layer, and second coloring is performed.

According to the above-described processes, the first coating colored in the first color may be damaged by cutting or polishing, so that the quality and durability of the product may be affected. Further, the process may be complicated and more time-consuming. Further, masking and masking removal may lead to increase in manufacturing costs, and defect rate may be proportional to the accuracy of masking.

According to an embodiment of the disclosure, there may be provided an electronic device comprising a housing at least partially including an electrically conductive material, wherein a surface of the electrically conductive material includes an oxide film layer having a plurality of cavities, wherein the plurality of cavities are colored in a first color and a second color, and wherein the first color and the second color are mixed when the second color is deposited on the first color.

According to an embodiment of the disclosure, there may be provided a method for manufacturing a housing, comprising anodizing forming an oxide film on a surface of a metallic member; first coloring an oxide film with a first colorant having a first color; decoloring to remove a portion of the first colorant of the oxide film colored in the first color; and second coloring the oxide film, colored in the first color, with a second colorant having a second color.

The disclosure is not limited to the foregoing embodiments but various modifications or changes may rather be made thereto without departing from the spirit and scope of the disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

With regard to description of drawings, the same or similar components will be marked by the same or similar reference signs.

DETAILED DESCRIPTION

According to an embodiment of the disclosure, there is provided an electronic device including a housing implemented in two or more colors and a method for manufacturing the housing thereof.

According to an embodiment of the disclosure, there is provided an electronic device including a housing implemented in colors, mixed naturally but without surface stains, and colorable in multiple colors using only with a single anodizing process, and a method for manufacturing the housing thereof.

According to an embodiment of the disclosure, the outer wall and inner wall of the electronic device are colored in multiple colors, thereby implementing an exterior design different from those in the prior art.

According to an embodiment of the disclosure, in the electronic device, it is possible to implement colors mixed naturally, without exposing the boundary surface between the multi-color portions.

According to an embodiment of the disclosure, there may be provided a method capable of saving costs and enhancing productivity by performing multi-coloring after performing a single anodizing process. Therefore additional processes conventionally used to implement multi-colors, such as additional anodizing, treatment, polishing, and masking, are avoided.

According to an embodiment of the disclosure, there may be provided a housing manufacturing method applicable to various products that use metal as their exterior material, as well as applicable to the exterior frame of portable electronic devices.

Figure 1:
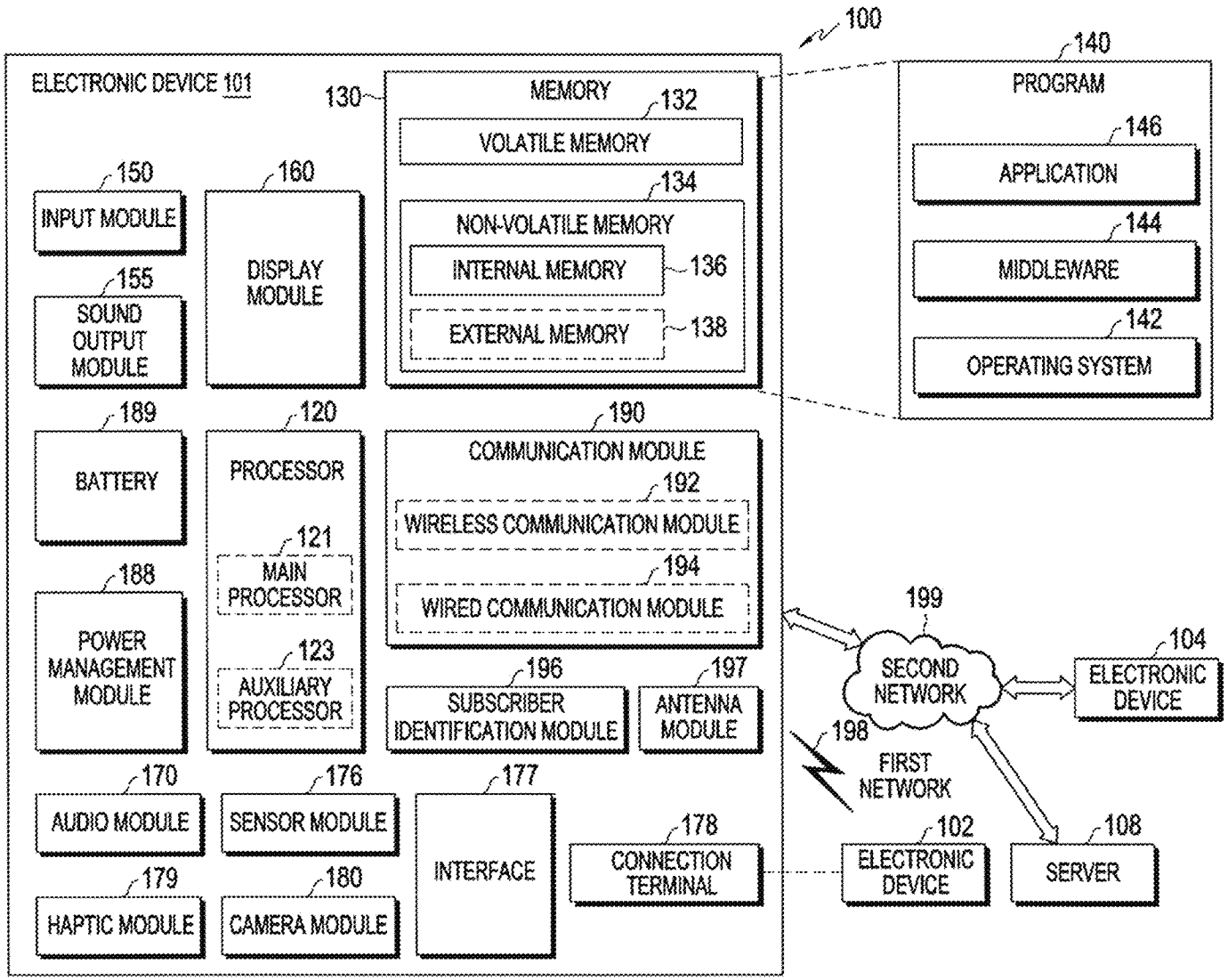
FIG. 1 is a view illustrating an electronic device in a network environment according to an embodiment.

FIG. 1 is a block diagram illustrating an electronic device 101 in a network environment 100 according to an embodiment.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input module 150, a sound output module 155, a display module 160, an audio module 170, a sensor module 176, an interface 177, a connecting terminal 178, a haptic module 179, a camera module 180, a power management module 188, a battery 189, a communication module 190, a subscriber identification module (SIM) 196, or an antenna module 197. In some embodiments, at least one (e.g., the connecting terminal 178) of the components may be omitted from the electronic device 101, or one or more other components may be added in the electronic device 101. According to an embodiment, some (e.g., the sensor module 176, the camera module 180, or the antenna module 197) of the components may be integrated into a single component (e.g., the display module 160). The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may store a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), or an auxiliary processor 123 (e.g., a graphics processing unit (GPU), a neural processing unit (NPU), an image signal processor (ISP), a sensor hub processor, or a communication processor (CP)) that is operable independently from, or in conjunction with, the main processor 121. For example, when the electronic device 101 includes the main processor 121 and the auxiliary processor 123, the auxiliary processor 123 may be configured to use lower power than the main processor 121 or to be specified for a designated function. The auxiliary processor 123 may be implemented as separate from, or as part of the main processor 121.

The auxiliary processor 123 may control at least some of functions or states related to at least one component (e.g., the display module 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123. According to an embodiment, the auxiliary processor 123 (e.g., the neural processing unit) may include a hardware structure specified for artificial intelligence model processing. The artificial intelligence model may be generated via machine learning. Such learning may be performed, e.g., by the electronic device 101 where the artificial intelligence is performed or via a separate server (e.g., the server 108). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted Boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input module 150 may receive a command or data to be used by other component (e.g., the processor 120) of the electronic device 101, from the outside (e.g., a user) of the electronic device 101. The input module 150 may include, for example, a microphone, a mouse, a keyboard, keys (e.g., buttons), or a digital pen (e.g., a stylus pen).

The sound output module 155 may output sound signals to the outside of the electronic device 101. The sound output module 155 may include, for example, a speaker or a receiver. The speaker may be used for general purposes, such as playing multimedia or playing record. The receiver may be used for receiving incoming calls. According to an embodiment, the receiver may be implemented as separate from, or as part of the speaker.

The display module 160 may visually provide information to the outside (e.g., a user) of the electronic device 101. The display module 160 may include, for example, a display, a hologram device, or a projector and control circuitry to control a corresponding one of the display, hologram device, and projector. According to an embodiment, the display 160 may include a touch sensor configured to detect a touch, or a pressure sensor configured to measure the intensity of a force generated by the touch.

The audio module 170 may convert a sound into an electrical signal and vice versa. According to an embodiment, the audio module 170 may obtain the sound via the input module 150, or output the sound via the sound output module 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or motion) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via a first network 198 (e.g., a short-range communication network, such as Bluetooth™, wireless-fidelity (Wi-Fi) direct, or infrared data association (IrDA)) or a second network 199 (e.g., a long-range communication network, such as a legacy cellular network, a 5G network, a next-generation communication network, the Internet, or a computer network (e.g., local area network (LAN) or wide area network (WAN)). These various types of communication modules may be implemented as a single component (e.g., a single chip), or may be implemented as multi components (e.g., multi chips) separate from each other. The wireless communication module 192 may identify or authenticate the electronic device 101 in a communication network, such as the first network 198 or the second network 199, using subscriber information (e.g., international mobile subscriber identity (IMSI)) stored in the subscriber identification module 196.

The wireless communication module 192 may support a 5G network, after a 4G network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 192 may support a high-frequency band (e.g., the mmWave band) to achieve, e.g., a high data transmission rate. The wireless communication module 192 may support various technologies for securing performance on a high-frequency band, such as, e.g., beamforming, massive multiple-input and multiple-output (massive MIMO), full dimensional MIMO (FD-MIMO), array antenna, analog beam-forming, or large scale antenna. The wireless communication module 192 may support various requirements specified in the electronic device 101, an external electronic device (e.g., the electronic device 104), or a network system (e.g., the second network 199). According to an embodiment, the wireless communication module 192 may support a peak data rate (e.g., 20 Gbps or more) for implementing eMBB, loss coverage (e.g., 164 dB or less) for implementing mMTC, or U-plane latency (e.g., 0.5 ms or less for each of downlink (DL) and uplink (UL), or a round trip of 1 ms or less) for implementing URLLC.

The antenna module 197 may transmit or receive a signal or power to or from the outside (e.g., the external electronic device). According to an embodiment, the antenna module may include an antenna including a radiator formed of a conductor or conductive pattern formed on a substrate (e.g., a printed circuit board (PCB)). According to an embodiment, the antenna module 197 may include a plurality of antennas (e.g., an antenna array). In this case, at least one antenna appropriate for a communication scheme used in a communication network, such as the first network 198 or the second network 199, may be selected from the plurality of antennas by, e.g., the communication module 190. The signal or the power may then be transmitted or received between the communication module 190 and the external electronic device via the selected at least one antenna. According to an embodiment, other parts (e.g., radio frequency integrated circuit (RFIC)) than the radiator may be further formed as part of the antenna module 197.

According to various embodiments, the antenna module 197 may form a mmWave antenna module. According to an embodiment, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. The external electronic devices 102 or 104 each may be a device of the same or a different type from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, mobile edge computing (MEC), or client-server computing technology may be used, for example. The electronic device 101 may provide ultra low-latency services using, e.g., distributed computing or mobile edge computing. In another embodiment, the external electronic device 104 may include an Internet-of-things (IoT) device. The server 108 may be an intelligent server using machine learning and/or a neural network. According to an embodiment, the external electronic device 104 or the server 108 may be included in the second network 199. The electronic device 101 may be applied to intelligent services (e.g., smart home, smart city, smart car, or health-care) based on 5G communication technology or IoT-related technology.

Figure 2:
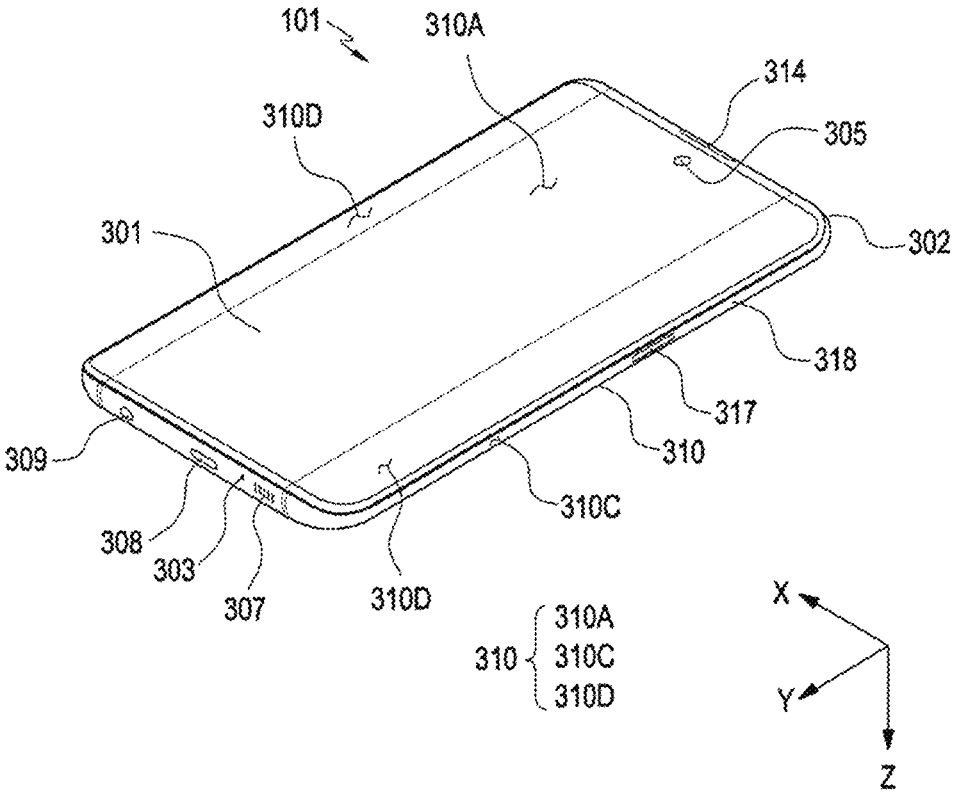
FIG. 2 is a front perspective view illustrating an electronic device according to an embodiment of the disclosure.
Figure 3:
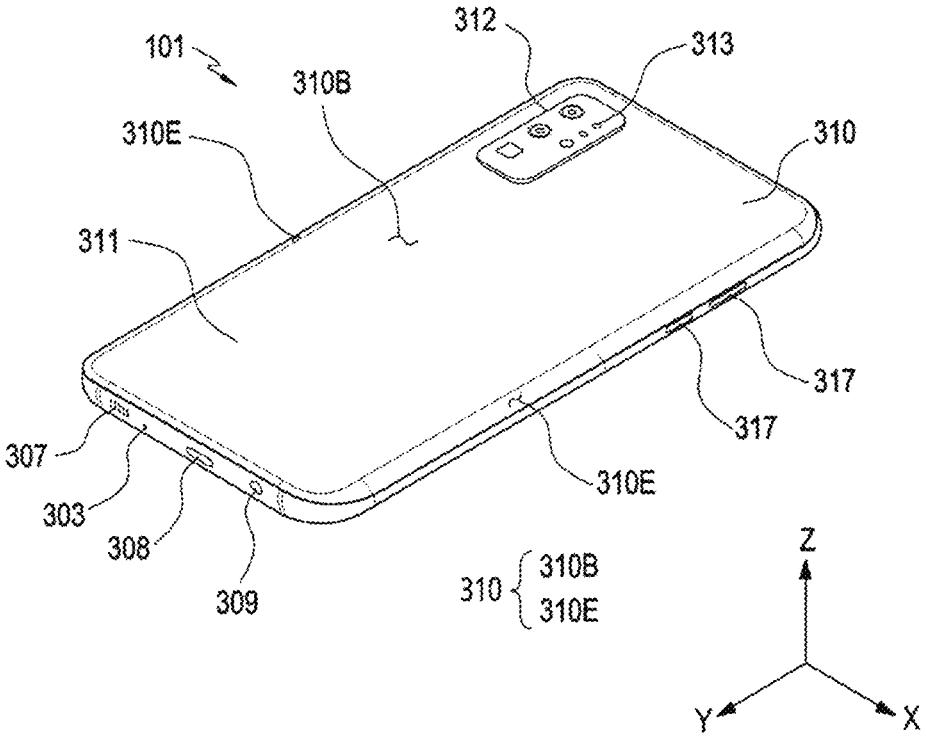
FIG. 3 is a rear perspective view illustrating an electronic device according to an embodiment of the disclosure.

FIG. 2 is a front perspective view illustrating an electronic device according to an embodiment of the disclosure. FIG. 3 is a rear perspective view illustrating an electronic device according to an embodiment of the disclosure.

Referring to FIGS. 2 and 3, according to an embodiment, an electronic device 101 may include a housing 310 with a front surface 310A, a rear surface 310B, and a side surface 310C surrounding the space between the front surface 310A and the rear surface 310B. According to another embodiment (not shown), the housing 310 may refer to a structure forming part of the front surface 310A, the rear surface 310B, and the side surface 310C of FIG. 2. According to an embodiment, at least part of the front surface 310A may have a substantially transparent front plate 302 (e.g., glass plate or polymer plate including various coating layers). The rear surface 310B may be implemented by a rear plate 311. The rear plate 311 may be made of, e.g., glass, ceramic, polymer, metal (e.g., aluminum, stainless steel (STS), or magnesium), or a combination of at least two thereof. The side surface 310C may be implemented by a side bezel structure (or "side member") 318 that couples to the front plate 302 and the rear plate 311 and may include metal and/or polymer. According to an embodiment, the rear plate 311 and the side bezel plate 318 may be integrated together and may be implemented using the same material (e.g., glass, metal, such as aluminum, or ceramic).

In the embodiment illustrated, the front plate 302 may include two first edge areas 310D, which seamlessly and bendingly extend from the first surface 310A to the rear plate 311, on both the long edges of the front plate 302. In the embodiment (refer to FIG. 3) illustrated, the rear plate 311 may include two second edge areas 310E, which seamlessly and bendingly extend from the rear surface 310B to the front plate, on both the long edges of the rear plate 311. According to an embodiment, the front plate 302 (or the rear plate 311) may include only one of the first edge areas 310D (or the second edge areas 310E). Alternatively, the first edge areas 310D or the second edge areas 301E may partially be excluded. According to an embodiment, in a side view of the electronic device 101, the side bezel structure 318 may have a first thickness (or width) for sides that do not have the first edge areas 310D or the second edge areas 310E and a second thickness, which is smaller than the first thickness, for sides that have the first edge areas 310D or the second edge areas 310E.

According to an embodiment, the electronic device 101 may include at least one of a display 301, audio modules 303, 307, and 314 (e.g., the audio module 170 of FIG. 1), a sensor module (e.g., the sensor module of FIG. 1). 176), camera modules 305, 312, and 313 (e.g., the camera module 180 of FIG. 1), a key input device 317 (e.g., the input module 150 of FIG. 1), and connector holes 308 and 309 (e.g., the connection terminal 178 of FIG. 1). According to an embodiment, the electronic device 101 may exclude at least one (e.g., the connector hole 309) of the components shown or may add other components not shown.

According to an embodiment, the display 301 may be visually exposed through, e.g., the majority portion of the front plate 302. According to an embodiment, at least a portion of the display 301 may be exposed through the front plate 302 forming the front surface 310A and the first edge areas 310D. According to an embodiment, the edge of the display 301 may be formed to be substantially the same in shape as the adjacent outer edge of the front plate 302. According to another embodiment (not shown), the interval between the outer edge of the display 301 and the outer edge of the front plate 302 may remain substantially even to give a larger area of exposure the display 301.

According to an embodiment, the surface (or the front plate 302) of the housing 310 may include a screen display area formed as the display 301 is visually exposed. For example, the screen display area may include the front surface 310A and first edge areas 310D.

According to an embodiment, a recess or opening may be formed in a portion of the screen display area (e.g., the front surface 310A or the first edge area 310D) of the display 301, and at least one or more of the audio module 314, sensor module (not shown), light emitting device (not shown), and camera module 305 may be aligned with the recess or opening. According to another embodiment (not shown), at least one or more of the audio module 314, sensor module (not shown), camera module 305, fingerprint sensor (not shown), and light emitting device (not shown) may be included on the rear surface of the screen display area of the display 301.

According to an embodiment (not shown), the display 301 may be disposed to be coupled with, or adjacent, a touch detecting circuit, a pressure sensor capable of measuring the strength (pressure) of touches, and/or a digitizer for detecting a magnetic field-type stylus pen.

According to a certain embodiment, at least part of the key input device 317 may be disposed in the first edge areas 310D and/or the second edge areas 310E.

According to an embodiment, the audio modules 303, 307, and 314 may include, e.g., a microphone hole 303 and speaker holes 307 and 314. The microphone hole 303 may correspond to a microphone disposed inside the electronic device to obtain external sound. According to an embodiment, there may be a plurality of microphones to be able to detect the direction of the sound. The speaker holes 307 and 314 may include an external speaker hole 307 and a phone receiver hole 314. In some embodiments, the speaker holes 307 and 314 and the microphone hole 303 may be implemented as a single hole, or a speaker may be included without the speaker holes 307 and 314 (e.g., piezo speaker). The audio modules 303, 307, and 314 are not limited to the above-described structure. Depending on the structure of the electronic device 101, various design changes may be made, e.g., only some of the audio modules may be mounted, or another audio module may be added.

According to an embodiment, the sensor modules (not shown) may generate an electrical signal or data value corresponding to an internal operating state or external environmental state of the electronic device 101. The sensor modules (not shown) may include a first sensor module (not shown) (e.g., proximity sensor) and/or a second sensor module (not shown) (e.g., fingerprint sensor) disposed on the front surface 310A of the housing 310 and/or a third sensor module (not shown) (e.g., heart-rate monitor (HRM) sensor) and/or a fourth sensor module (not shown) (e.g., fingerprint sensor) disposed on the rear surface 310B of the housing 310. In an embodiment (not shown), the fingerprint sensor may be disposed on the rear surface 310B as well as on the front surface 310A (e.g., the display 301) of the housing 310. The electronic device 101 may further include sensor modules not shown, such as a gesture sensor, a gyro sensor, an atmospheric pressure sensor, a magnetic sensor, an acceleration sensor, a grip sensor, a color sensor, an infrared (IR) sensor, a biometric sensor, a temperature sensor, a humidity sensor, or an illuminance sensor (not shown). The sensor module (not shown) is not limited to the above-described structure. Depending on the structure of the electronic device 101, various design changes may be made, e.g., only some of the sensor modules may be mounted, or another sensor module may be added.

According to an embodiment, the camera modules 305, 312, and 313 may include a first camera module 305 disposed on the first surface 310A of the electronic device 101, and a rear camera device 312 and/or a flash 313 disposed on the rear surface 310B. The camera modules 305 and 312 may include one or more lenses, an image sensor, and/or an image signal processor. The flash 313 may include, e.g., a light emitting diode (LED) or a xenon lamp. According to an embodiment, two or more lenses (an infrared (IR) camera, a wide-angle lens, and a telescopic lens) and image sensors may be disposed on one surface of the electronic device 101. The camera modules 305, 312, and 313 are not limited to the above-described structure. Depending on the structure of the electronic device 101, various design changes may be made, e.g., only some of the camera modules may be mounted, or another camera module may be added.

According to an embodiment, the electronic device 101 may include a plurality of camera modules (e.g., dual camera or triple camera) having different attributes (e.g., angle of view) or functions. For example, a plurality of camera modules 305 and 312 including lenses having different angles of view may be configured, and the electronic device 101 may control to change the angle of view of the camera modules 305 and 312 performed by the electronic device 101 based on the user's selection. At least one of the plurality of camera modules 305 and 312 may be, for example, a wide-angle camera and at least another of the plurality of camera modules may be a telephoto camera. Similarly, at least one of the plurality of camera modules 305 and 312 may be a front camera and at least another of the plurality of camera modules may be a rear camera. Further, the plurality of camera modules 305 and 312 may include at least one of a wide-angle camera, a telephoto camera, and an infrared (IR) camera (e.g., time of flight (TOF) camera or structured light camera). According to an embodiment, the IR camera may be operated as a sensor module. For example, the TOF camera may be operated as a sensor module for detecting the distance to the subject.

According to an embodiment, the key input device 317 may be disposed on the side surface 310C of the housing 310. According to an embodiment, the electronic device 101 may exclude all or some of the above-mentioned key input devices 317 and the excluded key input devices 317 may be implemented in other forms, e.g., as soft keys, on the display 301. According to an embodiment, the key input device may include the sensor module (not shown) disposed on the rear surface 310B of the housing 310.

According to an embodiment, the light emitting device (not shown) may be disposed on, e.g., the front surface 310A of the housing 310. The light emitting device (not shown) may provide, e.g., information about the state of the electronic device 101 in the form of light. According to another embodiment, the light emitting device (not shown) may provide a light source that interacts with, e.g., the front camera module 305. The light emitting device (not shown) may include, e.g., a light emitting device (LED), an infrared (IR) LED, and/or a xenon lamp.

According to an embodiment, the connector holes 308 and 309 may include, e.g., a first connector hole 308 for receiving a connector (e.g., universal serial bus (USB) connector) for transmitting or receiving power and/or data to/from an external electronic device and/or a second connector hole (e.g., earphone jack) 309 for receiving a connector for transmitting or receiving audio signals to/from the external electronic device. The connector holes 308 and 309 are not limited to the above-described structure. Depending on the structure of the electronic device 101, various design changes may be made, such as mounting only some of the connector holes or adding another connector hole.

According to an embodiment, the camera module 305 and/or the sensor module (not shown) may be disposed to be able to detect signals from the external environment through a designated area of the display 301 and the front plate 302 from the internal space of the electronic device 101. For example, the designated area may be an area in which pixels are not disposed in the display 301. As another example, the designated area may be an area in which pixels are disposed in the display 301. When viewed from above the display 301, at least a portion of the designated area may overlap the camera module 305 and/or the sensor module. As another example, some sensor modules may be arranged to perform their functions without being visually exposed through the front plate 302 from the internal space of the electronic device.

The electronic device 101 disclosed in FIGS. 2 and 3 has a bar-type or plate-type appearance but the disclosure is not limited thereto. For example, the illustrated electronic device may be part of a rollable electronic device or a foldable electronic device. "Rollable electronic device" may mean an electronic device at least a portion of which may be wound or rolled or received in a housing (e.g., the housing 310 of FIG. 2), and the display (e.g., the display 301 of FIG. 3) may be bent and deformed. As the display is stretched out or is exposed to the outside to be in a larger area according to the user's need, the rollable electronic device may implement an expanded second display area. "Foldable electronic device" may mean an electronic device that may be folded in directions to face two different areas of the display or in directions opposite to each other. In general, in the portable state, the foldable electronic device may be folded so that the two different areas of the display face each other and, in an actual use state, the user may unfold the display so that the two different areas form a substantially flat shape. In some embodiments, the electronic device 101 may be other devices besides portable electronic devices (e.g. the smartphone), such as laptop computers or home appliances.

Figure 4:
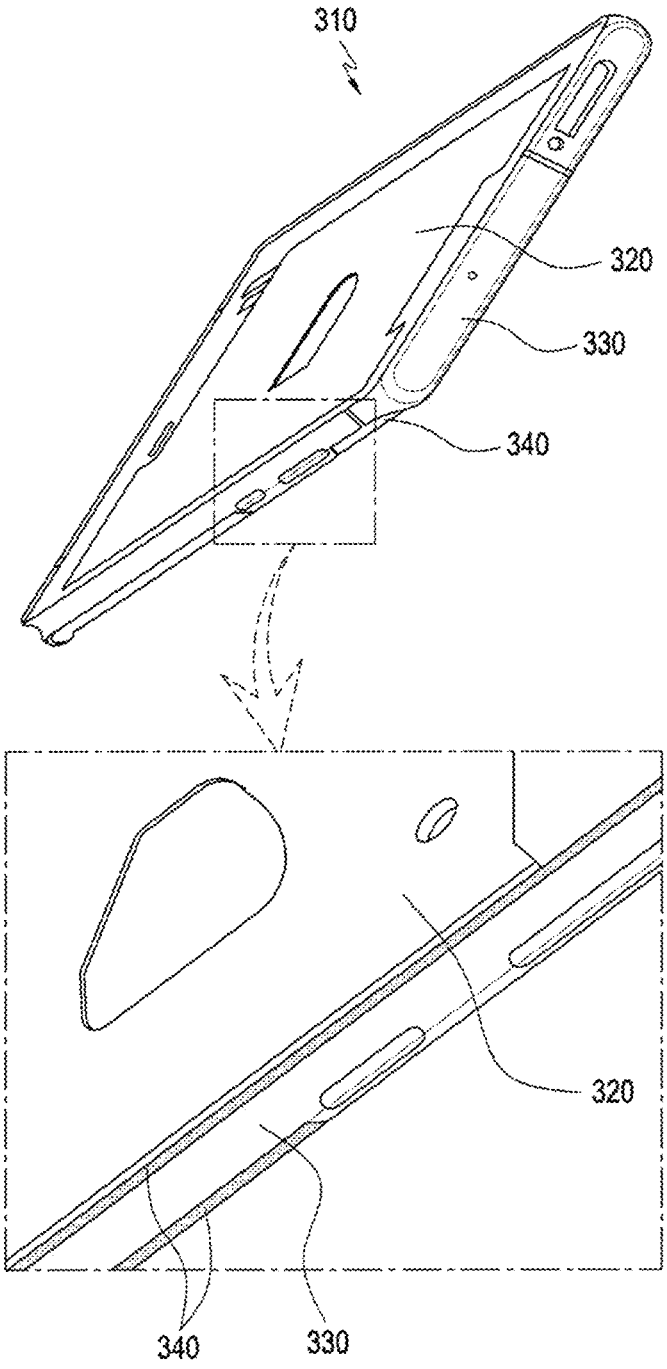
FIG. 4 is a view illustrating a housing of an electronic device according to an embodiment of the disclosure.

FIG. 4 is a view illustrating a housing 310 of an electronic device (e.g., the electronic device 101 of FIG. 1) according to an embodiment of the disclosure.

According to an embodiments of the disclosure, an electronic device (e.g., the electronic device 101 of FIG. 1) may include a housing 310 at least a portion of which includes an electrically conductive material. The housing 310 may be composed of a metallic (e.g., aluminum) frame, and may include, e.g., an outer wall 330 (or outer frame) that is a portion exposed to the outside when combined with the electronic device and an inner wall 320 (or inner frame) facing in the direction opposite to the outer wall 330. The housing 310 illustrated in FIG. 4 may have substantially the same configuration as the housing 310 described above in connection with FIGS. 2 and 3. For example, it is shown that the front plate portion is omitted from the housing 310 in FIG. 4, compared to the description above in connection with FIGS. 2 and 3, and the side bezel structure and the rear plate are coupled to each other. The electronic device may be configured to have various exterior appearances by adjusting the shape or size (e.g., length, height, or area) of the housing. Hereinafter, description duplicative with those made in connection with FIGS. 2 and 3 may be omitted.

The housing 310 may at least partially have an electrically conductive material for improved aesthetic appearance and/or to be used as an antenna. When at least a portion of the housing 310 is implemented with electrically conductive material, the rigidity of the electronic device may be increased.

Further according to an embodiment, as shown in FIG. 4, the housing 310 may include an insulating material (e.g., injection-molded material). The electrically conductive material of the housing 310 may be divided into at least two portions by the insulating portion 340 having the insulating material. The insulating portion 340 may play a role to restrict conductivity between some components of the electronic device and other components of the electronic device. For example, when the housing 310 of the electronic device is implemented by an electrically conductive material (e.g., metal), electrical disconnection may be created between some components of the housing and other components of the housing. For example, when the inner wall 320 and the outer wall 330 are made of a metallic material (e.g., aluminum), the insulating portion 340 may be formed between the inner wall 320 and the outer wall 330, electrically disconnecting the inner wall 320 and the outer wall 330 from each other. At least a portion of the housing 310 made of the electrically conductive material (e.g., metal) may be isolated by the insulating portion 340. It should be noted that the housing 310 being divided into at least two portions by the insulating portion 340 is not limited to those shown in the drawings, but changes may be made thereto in other embodiments. According to an embodiment, the side member and/or rear plate included in the housing 310 is illustrated as a portion of the electronic device but, without limited thereto, it may be implemented as a structure detachable from the housing 310 of the electronic device. For example, the side member and/or the rear plate may be coupled with the electronic device to protect the electronic device from external impact or foreign materials.

According to various embodiments, the housing 310 may be referred to by various terms, such as 'cover', 'case', 'envelope', 'exterior case', 'accessory case' or 'enclosure'. According to various embodiments, the side member 518 and/or rear plate 411 included in the housing 310 is not limited to the embodiments mentioned herein but may be formed in other various shapes depending on the shape of the electronic device.

According to an embodiment of the disclosure, the housing 310 may have a form in which at least two or more colors are mixed. For example, the housing 310 may include the inner wall 320 and the outer wall 330 in which two, three, or four or more colors are mixed. The housing 310 may include the inner wall 320 and the outer wall 330 implemented in various colors depending on the number of colors mixed and, in this case, the various colors may be implemented as gradations in which color changes are continuous, so that there is no color boundary.

According to an embodiment of the disclosure, in the housing 310, the inner wall 320 and the outer wall 330 may be formed to have the same color mixture. According to an embodiment of the disclosure, although the insulating portion 340 is present between the inner wall 320 and the outer wall 330, the inner wall 320 and the outer wall 330 may be implemented to have the same color.

Anodizing may be used as a method for implementing various colors in the housing 310. A method for manufacturing the housing 310 using anodizing is described below in detail.

First, a pre-treatment process may be performed before performing anodizing in the housing manufacturing method. The pre-treatment process may include product design, processing/bonding raw materials, and injection and/or machining.

For example, as product design, design of the exterior appearance and shape of the product is performed. After determining what design the exterior appearance is to be implemented, how many colors the exterior appearance is to be implemented, and what color is to be disposed in what position, a section for disposing the electrically conductive material (e.g., metal) (hereinafter, "metallic member") may be selected. Here, the electrically conductive material may form the inner wall 320 and/or the outer wall 330 of FIG. 4. The raw material of the housing including the metallic member may be prepared. For example, an aluminum plate material, which is used as the exterior or interior material of the electronic device, may be used as the raw material of the housing. The aluminum plate material may include, e.g., 2xxx series alloy, 6xxx series alloy, and/or high strength 7xxx series alloy, but not pure aluminum. For example, the aluminum alloy may include aluminum as its main component, and copper, magnesium, manganese, silicon, tin, or zinc as a main alloying element.

Next, the raw material of the housing including the metallic member may be subjected to cutting and bonding. The housing 310 may be formed into the desired shape by cutting. After cutting, the member is subjected to bonding. Bonding here may mean any chemical or physical processing that is capable of bonding metal and the molten resin injected in the injection process. Without bonding, the metal may be less bondable to the injected resin and the finished product may be broken or separated. Thus, bonding may be required to be performed before the injection process. The molten resin may be injected to the metallic member through the injection process, so that the resin and the metal may be bonded to each other. Here, the resin bonded with the metal may form the insulating portion 340 of FIG. 4.

After the injection process, the material may be processed into a final shape by machining. Machining here may include processes such as polishing (wet or dry polishing), simple cutting, and diamond cutting (dia-cut) to produce the final exterior shape of the exterior material. According to an embodiment, polishing is performed to implement high gloss on the surface of the metallic member to be applied to the electronic device, and such polishing may include physical polishing (dry/wet polishing) and/or electropolishing. For polishing, physical polishing may be performed, followed by electropolishing. As another example, physical polishing may be performed after electropolishing. As another example, either physical polishing or electropolishing may be performed. For example, physical polishing may be performed by bringing a rotating polisher in contact with the surface of the metallic member. For physical polishing, either wet polishing, which is performed with the surface of the metallic member wet, or dry polishing, which is performed with the surface of the metallic member dry, may be selected and performed. Electropolishing may planarize and/or gloss the surface of the metallic member using anodic dissolution. According to an embodiment, after polishing (e.g., physical polishing and/or electropolishing) is done, surface roughening may be performed. Surface roughening may be performed after physical polishing or electropolishing is done. As another example, surface roughening may be performed after physical polishing and electropolishing are sequentially done or without polishing. According to an embodiment, surface roughening may be performed to implement bumps (e.g., roughness) on the surface of the metallic member to be applied to the electronic device and may include methods of physically applying force, e.g., sand blasting, and/or methods of chemically applying force, e.g., chemical etching. The machining process contemplated herein may include other processes used to implement exterior design, such as barrel polishing, sand blasting, or hairline finishing.

The pre-treatment processing is not limited to the above-described embodiments. According to an embodiment of the disclosure, the pre-treatment processing may add more processes or omit some of the above-described processes.

Anodizing process may be performed in the manufacturing of the housing. The anodizing process may be divided into cleaning, anodic oxide coating (or anodizing), coloring, and/or post-treatment process (or sealing).

Cleaning may include degreasing, chemical polishing, and desmutting. Degreasing may be performed to clear foreign materials on the metal surface. In this case, degreasing may selectively adopt an acidic or neutral degreasing solution depending on the processing environment and target material. Chemical polishing may be performed to planarize the uneven surface of the material to thereby reduce diffuse reflection and enhance surface gloss. Chemical polishing may planarize the surface bumps with an acid solution, such as phosphoric acid, sulfuric acid, nitric acid, and the like. Desmutting may be performed to remove residues (e.g., smut and other foreign substances) on the surface of the material generated from degreasing and chemical polishing.

An anodic oxide coating (or anodizing) may be formed by anodizing the surface of the metallic exterior material. Anodic oxide coating may be performed by preparing a device for containing an electrolyte including at least one or all of electrolytes containing sulfuric acid, oxalic acid, phosphoric acid, chromic acid, organic acids (citric acid, acetic acid, propionic acid, tartaric acid) or boric acid, putting the housing including the metallic member in the electrolyte, and providing a predetermined voltage and temperature. Anodic oxide coating may cause a reaction with oxygen while applying voltage to the metallic member, forming a high-density coating. For example, the voltage used may range from about 5V to 15V, and the processing time may be about 10 minutes to about 3 hours. The processing temperature may range from about 5° C. to about 30° C. By the anodic oxide coating, an anodic oxide film is made.

After anodizing process, coloring process may be performed. Coloring process may be a process for adding a color to the anodized oxide film. For example, types of coloring process may include immersion, electrocoloring, or oil-based coloring. Immersion is a method that immerses the product in a dye-dissolved solution to implement a color as the dye is absorbed by and spread in the product. Electrocoloring is a method that implements a color by performing electrolysis on the metal salt electrolyte using a rectifier and then applying current thereto. Oil-based coloring is a coloring method that photosensitizes and dries the oxide film and then applies an oil dye to the oxide film with a brush. Types of dyes for immersion may include organic or inorganic dyes. As the dyes for immersion are dissolved mainly in water, immersion may also be called water-based coloring.

As the post-treatment process, sealing and post-sealing process may be performed. Sealing may include processing including a metal salt and non-metal salt processing based on an organic material. Sealing may include hydro-thermal sealing using water and steam. The post-sealing process may include elution for removing the metal salt or hot water washing for washing out foreign substances. Such post-treatment processes may be performed to secure exterior stability and reliability of the anodized and colored material. Typically, the colored housing may have a single color.

According to an embodiment of the disclosure, the housing 310 is formed in a mixture of a plurality of colors, rather than simply in multiple colors that are separate. Comparative embodiments for housings 400 and 600 implemented to have a plurality of colors which are not mixed and the method for manufacturing the same are described with reference to FIGS. 5A and 5B and FIGS. 6A and 6B. Embodiments of a housing 800 having a mixture of a plurality of colors and the method for manufacturing the same are described with reference to FIGS. 7A to 7C.

Figure 5A:
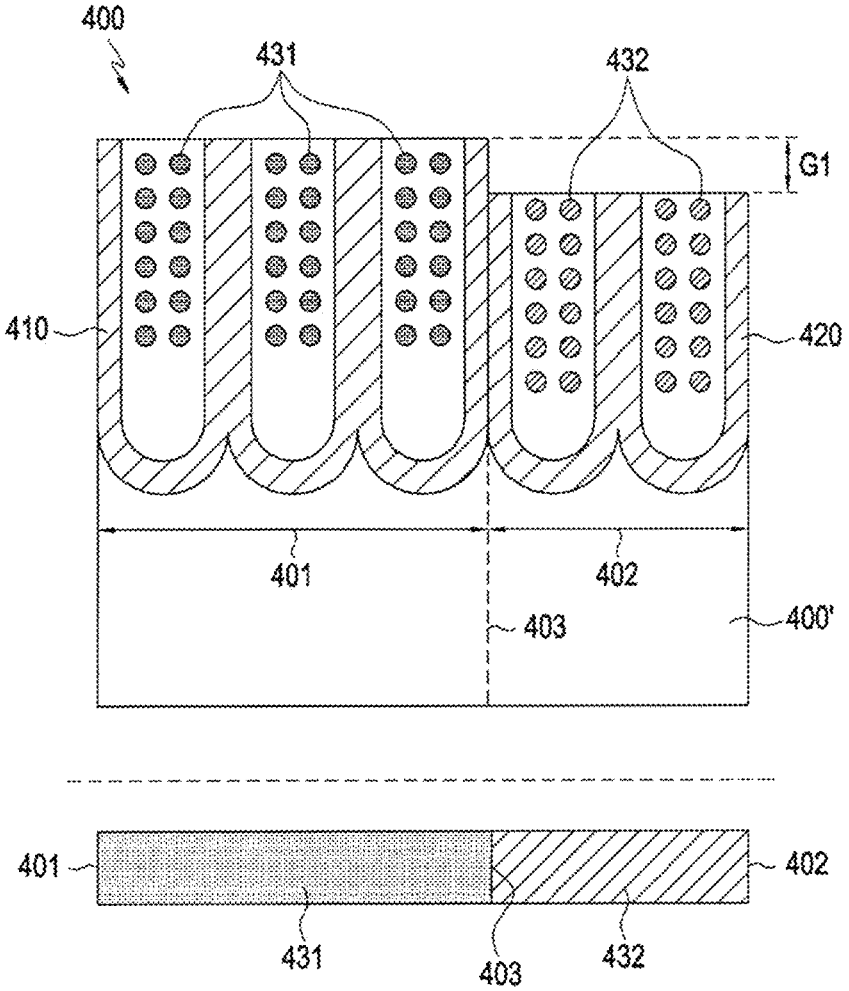
FIG. 5A is a view illustrating a housing including a plurality of cavities according to an embodiment.
Figure 5B:
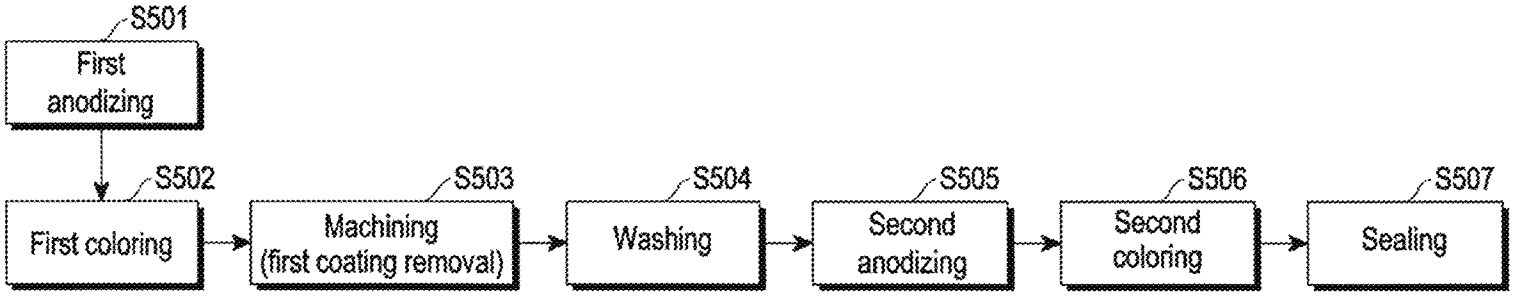
FIG. 5B is a view illustrating a method for manufacturing a housing including a plurality of cavities according to the embodiment shown in FIG. 5A.

FIG. 5A is a view illustrating a housing including a plurality of cavities according to an embodiment (comparative embodiment). FIG. 5B is a view illustrating a method for manufacturing a housing including a plurality of cavities according to the embodiment shown in FIG. 5A.

FIGS. 5A and 5B illustrate a housing 400 including a plurality of cavities and a method for manufacturing the same.

According to a certain embodiment, as shown in FIGS. 5A and 5B, it is possible to manufacture a housing 400 implemented with a plurality of colors by performing anodizing S501 and S505 twice, coloring S502 and S506 twice, and sealing S507.

Referring to FIGS. 5A and 5B, as part of the anodizing process, first anodizing S501 may be performed to form an oxide film layer 400' including a plurality of cavities 410 in the surface of the housing. Further, second anodizing S505 may be performed to form an oxide film layer 400' including a plurality of cavities 420 in the surface of the housing. To implement multiple colors, according to an embodiment, a first color 431 may be formed through first coloring process S502, and a second color 432 may be formed through second coloring process S506 as shown in FIG. 5A.

In the comparative embodiment of FIGS. 5A and 5B, machining S503 and washing S504 may be included between first anodizing S501 and second anodizing S505. Machining S503 may be a process for removing a portion of the oxide film layer 400' by polishing the oxide film (or the plurality of cavities) generated with the first anodizing or cutting the section that needs to be colored in different colors, after the section is colored in the color according to the first anodizing and the first coloring S502. Washing S504 may be a process that washes the surface which is subject to second anodizing S505 by removing byproducts (e.g., cutting oil, processing burrs, or other foreign substances) generated during machining S503.

According to the comparative embodiment shown in FIGS. 5A and 5B, when cutting of the portion colored in the first color through machining S503 or removing of a portion of the oxide film layer 400' formed through first anodizing S501 is included as part of the manufacturing process, a step may be formed on the surface of the housing (e.g., the housing 310 of FIG. 4). For example, the cavities 420 formed through second anodizing S505 may be portions formed on the oxide film that has collapsed because of the machining S503 or portions newly formed on the oxide film through second anodizing S505. Accordingly, a gap G1 may be formed between the cavities 410 formed through first anodizing S501 and the cavities 420 formed through second anodizing S505.

Further, according to the comparative embodiment shown in FIGS. 5A and 5B, the cavities 410 and 420 formed to have a step may be colored in the first color 431 formed through first coloring S502 and the second color 432 formed through second coloring S506. Here, the cavities 410 implemented in the first color may be denoted as a first color layer 401 of the oxide film layer 400', and the cavities 420 implemented in the second color may be denoted as a second color layer 402 of the oxide film layer 400'. The color boundary may be clearly seen at the boundary surface 403 between the first color layer 401 and the second color layer 402.

Figure 6A:
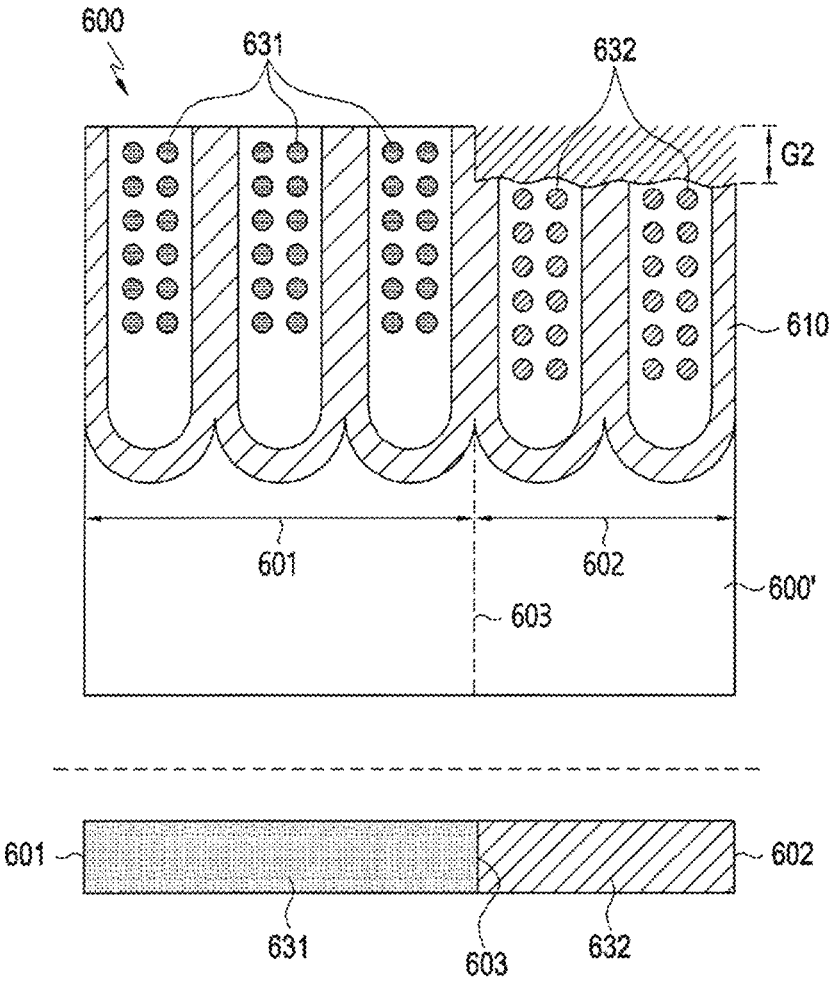
FIG. 6A is a view illustrating a housing including a plurality of cavities according to an embodiment different from that of FIG. 5A.
Figure 6B:
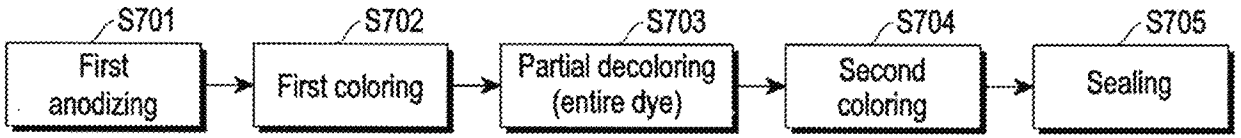
FIG. 6B is a view illustrating a method for manufacturing a housing including a plurality of cavities according to the embodiment shown in FIG. 6A.

FIG. 6A is a view illustrating a housing including a plurality of cavities according to an embodiment (another comparative embodiment) different from that of FIG. 5A. FIG. 6B is a view illustrating a method for manufacturing a housing including a plurality of cavities according to the embodiment shown in FIG. 6A.

FIGS. 6A and 6B illustrate a housing 600 including a plurality of cavities and a method for manufacturing the same.

According to a certain embodiment, as shown in FIGS. 6A and 6B, it is possible to manufacture a housing 600 implemented with a plurality of colors by performing anodizing S701 once, coloring S702 and S704 twice, and sealing S705.

Referring to FIGS. 6A and 6B, anodizing S701 may be performed to form an oxide film layer 600' including a plurality of cavities 610 in the surface of the housing. To implement multiple colors in the oxide film layer 600', according to an embodiment, a first color 631 may be formed through first coloring process S702, and a second color 632 may be formed through second coloring process S704 as shown in FIG. 6A.

In the embodiment of FIGS. 6A and 6B, partial decoloring S703 may be performed between first coloring process S702 and second coloring process S704 after anodizing S701. Partial decoloring S703 may be etching a partial surface of the oxide film layer 600' and decoloring the portion after colored in the color according to first anodizing and the first coloring process S702. For example, the entire first color 631 in some of the cavities 610 may be removed by etching a partial surface of the oxide film layer 600' with a large amount of alkali solution.

According to the comparative embodiment shown in FIGS. 6A and 6B, since deep etching to the surface is performed using an alkali solution to remove the first color 631, the cavities 610 may collapse, reducing the degree of coloration and creating a step on the surface of the housing (e.g., the housing 310 of FIG. 4). For example, a gap G2 may be formed between a portion of the upper surface of the cavities 610 formed through the anodizing and the surface-etched portion.

Further, according to the comparative embodiment shown in FIGS. 6A and 6B, the cavities 610 formed to have a step may be colored in the first color 631 formed through first coloring S702 and the second color 632 formed through second coloring S704. Here, the cavities 610 implemented in the first color may be denoted as a first color layer 601 of the oxide film layer 600', and the cavities 620 implemented in the second color may be denoted as a second color layer 602 of the oxide film layer 600'. The color boundary may be clearly seen at the boundary surface 603 between the first color layer 601 and the second color layer 602.

According to the comparative embodiment shown in FIGS. 5A to 6B, the boundary between the first color and the second color may be clearly visible to the user, and it may be difficult to implement natural continuity and gradation of colors when implementing a plurality of colors. Accordingly, according to certain embodiments of the disclosure, there is provided a housing in which a first color and a second color are mixed to achieve continuity without a boundary therebetween.

Figure 7A:
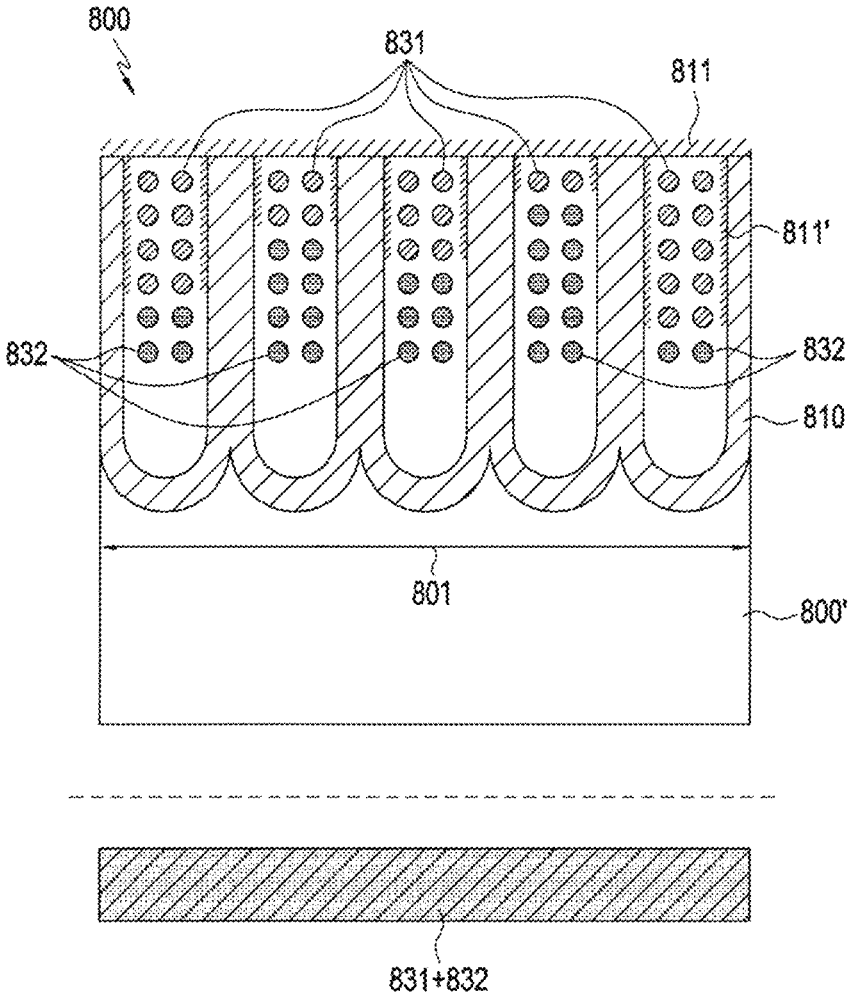
FIG. 7A is a view illustrating a housing including a plurality of cavities according to an embodiment of the disclosure.
Figure 7B:
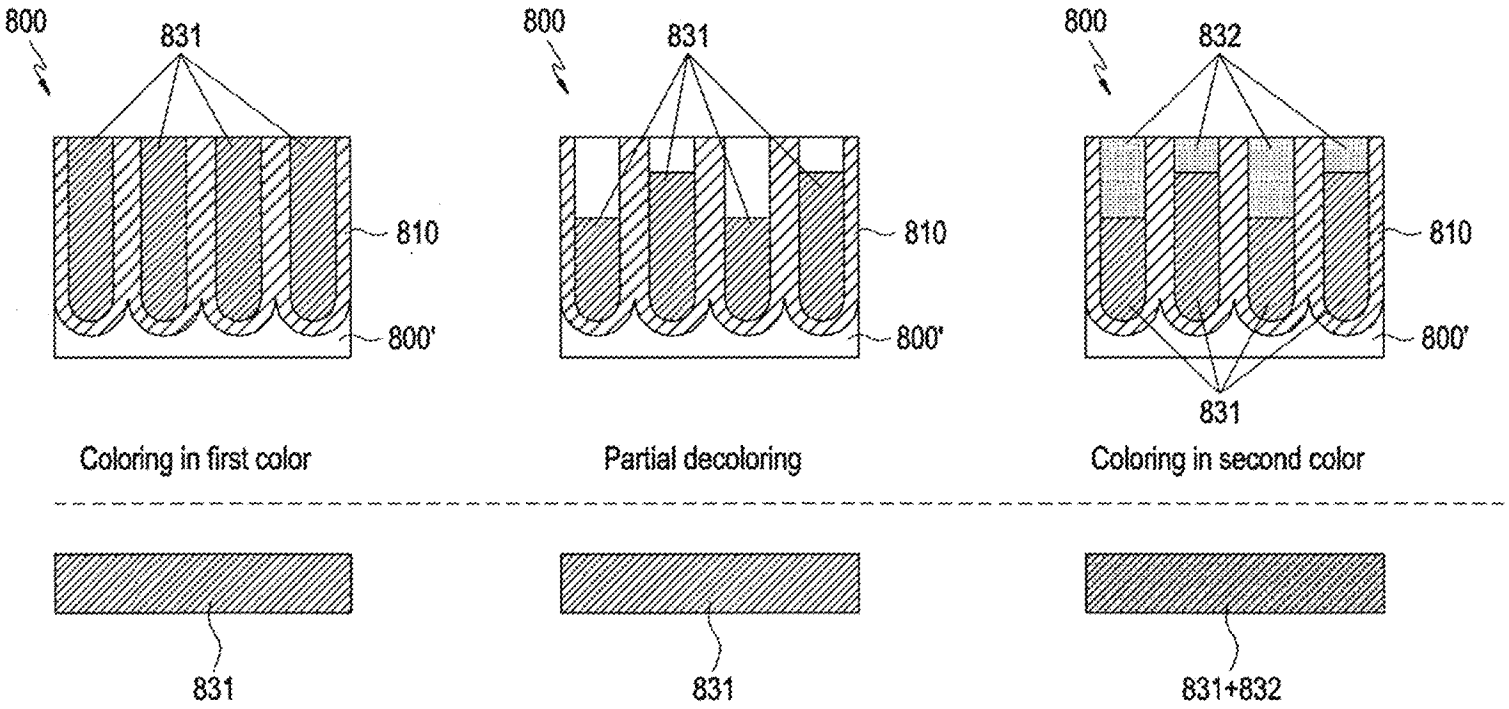
FIG. 7B is a view illustrating first coloring, partial decoloring, and second coloring according to an embodiment of the disclosure.
Figure 7C:
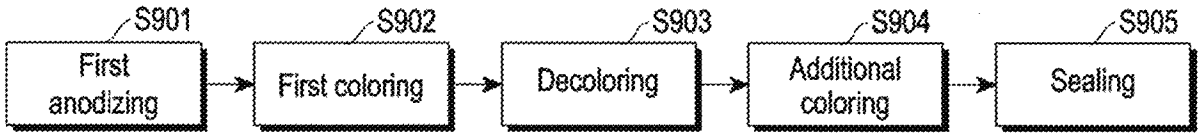
FIG. 7C is a view illustrating a method for manufacturing a housing including a plurality of cavities according to an embodiment of the disclosure.

FIG. 7A is a view illustrating a housing including a plurality of cavities according to an embodiment of the disclosure. FIG. 7B is a view illustrating first coloring, partial decoloring, and second coloring according to an embodiment of the disclosure. FIG. 7C is a view illustrating a method for manufacturing a housing including a plurality of cavities according to an embodiment of the disclosure.

FIGS. 7A to 7C illustrate a housing 800 including a plurality of cavities and a method for manufacturing the same.

According to an embodiment of the disclosure, as shown in FIGS. 7A to 7C, it is possible to manufacture a housing 800 implemented with a plurality of colors by performing anodizing S901 once, coloring S902 and S904 twice, and sealing S905.

Referring to FIGS. 7A to 7C, anodizing S901 may be performed to form an oxide film layer 800' including a plurality of cavities 810 in the surface of the housing. To implement multiple colors in the oxide film layer 800', a first color 831 may be formed through first coloring S902, and a second color 832 may be formed through second coloring S904 as shown in FIG. 7C.

In the embodiment of FIGS. 7A to 7C, decoloring S903 may be performed between the first coloring S902 and the additional (i.e. second) coloring S904 after anodizing S901. Decoloring S903 of the disclosure may be etching the surface of the oxide film layer 800' and decoloring the portion after colored in the color according to first anodizing and first coloring S902. Unlike in the embodiment of FIGS. 6A and 6B, in the embodiments disclosed herein, it is possible to remove only portions of the first color 831 in the entire cavity 810 by etching the entire surface of the oxide film layer 800' using a small amount of acidic solution. Since a small amount of acidic solution is used, not all of the first color 831 in the cavities 810 may be removed. Further, according to an embodiment of the disclosure, since etching is performed on the entire surface of the oxide film layer 800' to a shallow depth using a small amount of acidic solution, additional coloring may be performed while the cavities 810 do not collapse.

According to the embodiment shown in FIGS. 7A to 7C, coloring in the first color 831 and the second color 832 may adopt waster-based coloring that dilutes an organic dye with water and deposits it. In this case, the temperature of the coloring tank may be set to about 30° C. to about 60° C., and the amount of dye added may be from about 0.1 g/L to about 10 g/L depending on the depth of color. According to an embodiment, the coloring time may be set to be short for light color and to be long for dark color.

According to the embodiment shown in FIGS. 7A to 7C, decoloring in various embodiments of the disclosure may be partially removing the dye deposited in the oxide film 800' using a small amount of acidic solution. In this case, the type of the acidic solution may be sulfuric acid, nitric acid, oxalic acid, phosphoric acid, chromic acid, hydrochloric acid, acetic acid, and/or organic acid. The concentration of the acidic solution used in the decoloring may be set to range from about 5 g/L to about 800 g/L. In this case, the deposition time may be performed from about 5 seconds to about 30 minutes. Upon additional coloring after decoloring, the portion where the first color has been removed may be colored in the second color, so that such an effect as if the first and second colors are naturally mixed may be presented. It is also possible to implement mixed color of three or more colors by repeating the above-described method. Further, the acidic solution may react with the oxide film, forming fine bumps 811 on the surface of the housing 800 or fine bumps 811' on the inner surface of the cavities 810.

Referring to FIGS. 7A to 7C, since fine etching on the surface using a small amount of acidic solution to partially remove the first color 831 is performed, no step is formed on the surface of the housing 800. The first color and the second color together may be formed on the mixed color layer 801 which is not stepped. For example, the first color 831 may be implemented using a blue dye during first coloring and, after decoloring, the second color 832 may be implemented using a red dye during second coloring. After undergoing first coloring and second coloring, the housing 800 may have a red blue color which is a mixture of blue and red.

Figure 8:
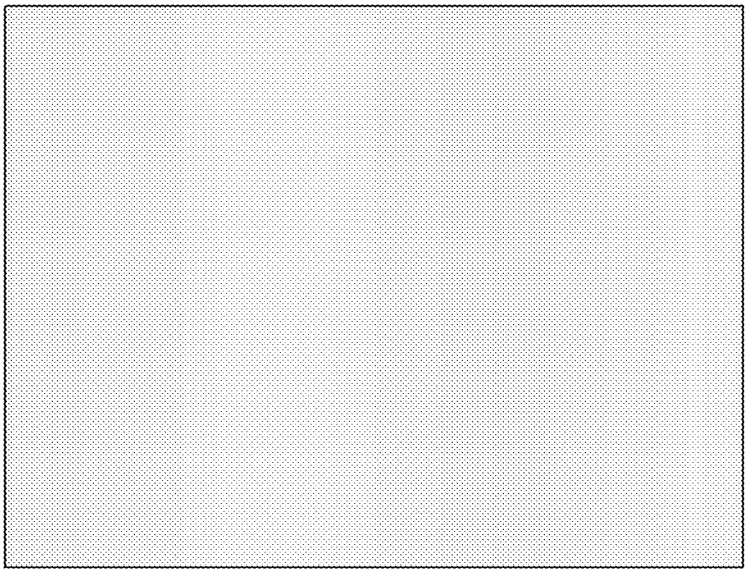
FIG. 8 is a view illustrating a mixed color layer of a first color and a second color according to an embodiment of the disclosure.

According to an embodiment, new texture (e.g., haze) may be implemented due to the fine bumps 811 formed on the surface of the housing 800 and the fine bumps 811' formed on the inner surface of the cavities 810. For example, the fine bumps 811 and 811' may have a size of about 0.3 μm to about 0.5 μm and, despite the presence of such fine bumps 811 and 811', no or little influence may be had on the overall color as shown in FIG. 8. According to another embodiment, the fine bumps 811' formed on the inner surface of the cavities 810 may serve to increase adhesion with the dye used in the second coloring. According to an embodiment, after first coloring and second coloring, sealing of the surface of the housing may further be performed. However, the dye may be prevented from leaking out from inside of the cavities 810 before sealing, due to the adhesion between the fine bumps 811' formed on the inner surface of the cavities 810 and the dye used for the second coloring.

FIG. 8 is a view illustrating a mixed color layer of a first color and a second color according to an embodiment of the disclosure.

FIG. 8 may illustrate the exterior appearance of a product implemented in red blue (i.e. purple or violet) color by mixing blue dye and red dye. As may be seen from the exterior, the boundary between the two colors is unclear and the colors may have continuity.

The above-described embodiments are summarized. According to the electronic device and method for manufacturing the housing of the electronic device according to the embodiment shown in FIGS. 7A to 7C, the outer wall and inner wall of the electronic device may be colored in multiple colors, implementing an exterior design different from those in the prior art. Further, according to the electronic device and method for manufacturing the housing of the electronic device of the embodiment shown in FIGS. 7A to 7C, it is advantageously possible to implement colors which are naturally mixed, without having a boundary surface or line between the multiple colors. Further, according to the embodiment shown in FIGS. 7A to 7C, there may be provided a method capable of saving costs and enhancing productivity by performing multi-coloring after performing a single anodizing process without additional complicated processes, such as additional anodizing, treatment, polishing, and masking.

Figure 9:
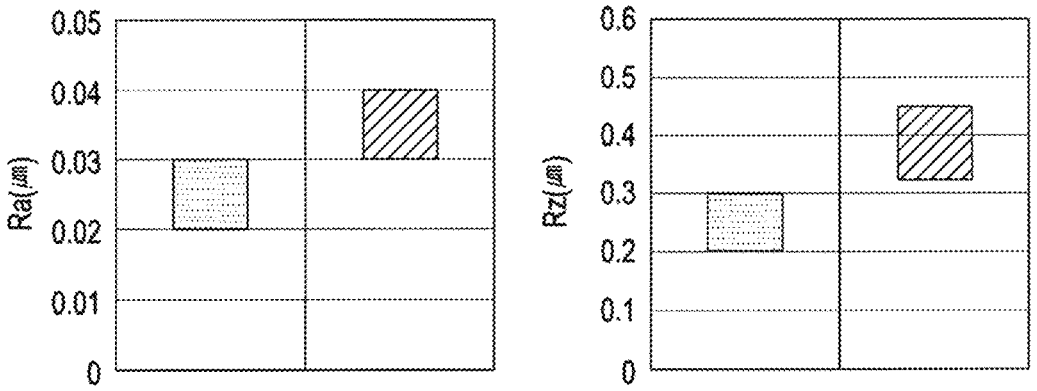
FIG. 9 is a graphs illustrating the result of measuring the surface roughness of a housing according to an embodiment of the disclosure.

FIG. 9 is a graphs illustrating the result of measuring the surface roughness of a housing according to an embodiment of the disclosure.

As shown in FIGS. 7A to 7C, according to an embodiment of the disclosure, the acidic solution used for decoloring may form fine bumps 811 and 811' on the surface of the aluminum product and inside the cavities 810 and may implement different texture from that in the embodiment described above in connection with FIGS. 6A and 6B.

To verify this, an experiment for measuring surface roughness may be performed. FIG. 9(*a*) may show the arithmetical mean roughness 1001 of the housing according to the embodiment of FIGS. 6A and 6B and the arithmetical mean roughness 1002 of the housing according to the embodiment of FIGS. 7A to 7C. FIG. 9(*b*) may show the ten-point mean roughness 1003 of the housing according to the embodiment of FIGS. 6A and 6B and the ten-point mean roughness 1004 of the housing according to the embodiment of FIGS. 7A to 7C.

Referring to FIGS. 9(*a*) and (*b*), the arithmetical mean roughness 1001 of the housing according to the embodiment shown in FIGS. 6A and 6B may be 0.02 to 0.03 μm, and the ten-point mean roughness 1003 of the housing may be 0.2 to 0.3 μm. The arithmetical mean roughness 1002 of the housing according to the embodiment shown in FIGS. 7A to 7C may be 0.03 to 0.04 μm, and the ten-point mean roughness 1004 of the housing may be 0.32 to 0.45 μm.

For electronic devices, such as portable terminals, coating stability, such as corrosion resistance and abrasion resistance, as well as the exterior texture of the product, may be considered as critical factors.

Figure 10:
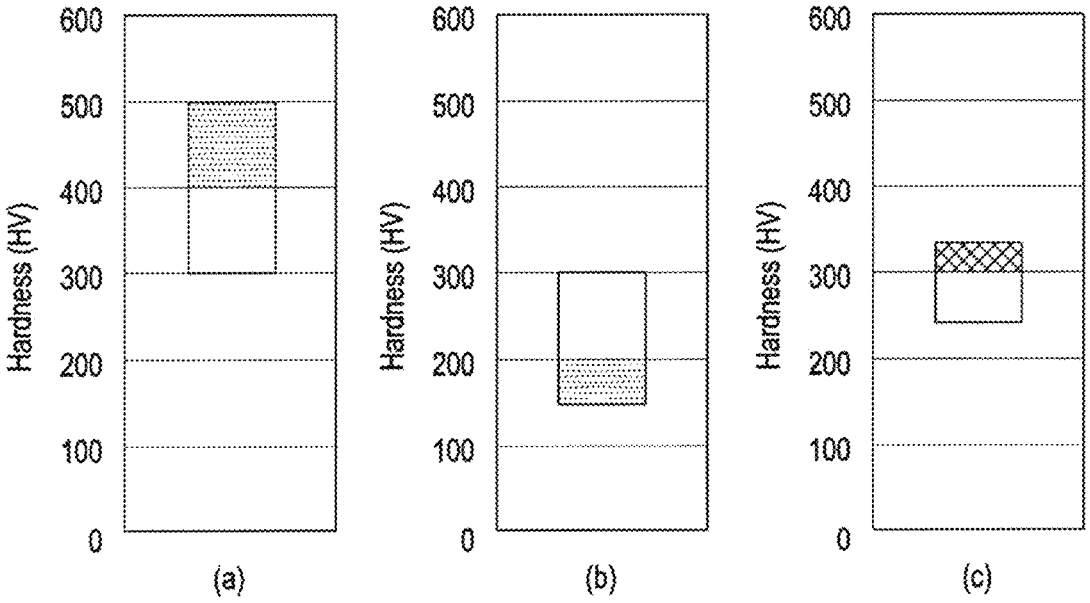
FIG. 10 is a graphs illustrating the result of measuring the oxide film hardness of a housing according to an embodiment of the disclosure.

FIG. 10 is a graphs illustrating the result of measuring the oxide film hardness of a housing according to an embodiment of the disclosure.

To identify the coating stability of the housing of the electronic device, an experiment to measure the coating hardness (Vickers hardness (HV), load: 100 g) may be performed.

FIG. 10(*a*) shows the coating hardness of a commonly used housing component. FIG. 10(*b*) shows the coating hardness of a commonly used housing used for decoration. The hardness of the anodized oxide film may be affected by conditions, such as the type, concentration, temperature, and current density of the electrolyte, and may also be affected by machining and decoloring. The coating hardness of the component housing commonly used may be 300 to 500 HV, and the coating hardness of the decorative housing may be 150 to 300 HV. As contrasted, FIG. 10(*c*) may show the coating hardness of the housing according to the embodiment shown in FIGS. 7A to 7C. Referring to FIG. 10(*c*), although decoloring is repeatedly performed to implement mixed colors, it may be identified that a hardness of 240 to 320 HV may be presented, so that no issue arises with durability when it is adopted as a housing of the outer cover of the electronic device.

Figure 11:
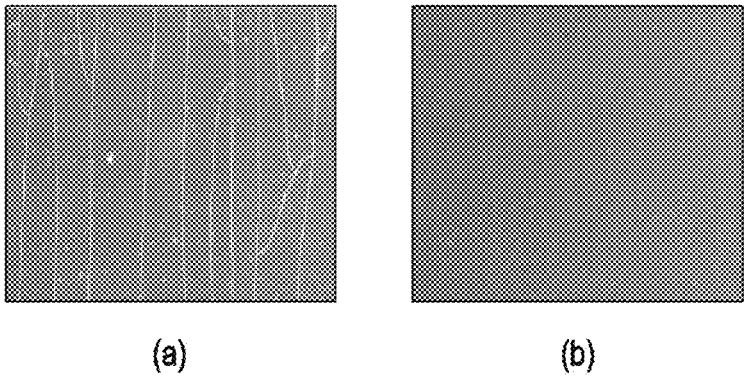
FIG. 11 is a view illustrating the result of observing a surface crack of a housing according to an embodiment of the disclosure.

FIG. 11 is a view illustrating the result of observing a surface crack of a housing according to an embodiment of the disclosure.

To identify the coating stability of the surface of the housing of the electronic device, cracks may be identified by observing the surface of the housing.

FIG. 11(*a*) may show the surface of the housing according to the comparative embodiment of FIGS. 6A and 6B, and FIG. 11(*b*) may show the surface of the housing according to the embodiment of FIGS. 7A to 7C. Performing decoloring by etching the surface using a large amount of alkali solution has been described above in connection with the comparative embodiment of FIGS. 6A and 6B, and performing decoloring by etching the surface using a small amount of acidic solution has been described above in connection with FIGS. 7A and 7B. Referring to FIG. 11(*a*), it may be identified that fine cracks are sporadically caused due to chemical damage to the surface of the housing. In contrast, referring to FIG. 11(*b*), no cracks are observed on the surface of the housing. If durability is not secured for the anodized coating, fine or sporadic cracks may be observed on the surface due to chemical damage as shown in FIG. 11(*a*). However, according to various embodiments of the disclosure, it may be identified that the reliability and durability of the coating may be met although decoloring is performed using an acidic solution as shown in FIG. 11(*b*).

What has been described above in connection with the embodiment of FIGS. 9 to 11 may be summarized as follows. It is possible to provide a housing which may have various types of exterior texture along with superior coating stability, e.g., high corrosion resistance and high abrasion resistance, and a method for manufacturing the housing by applying the embodiment of FIGS. 7A to 7C.

The electronic device according to am embodiment of the disclosure may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases.

As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

According to an embodiment, each component (e.g., a module or a program) of the above-described components may include a single entity or multiple entities. Some of the plurality of entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to an embodiment, there may be provided an electronic device comprising a housing (e.g., the housing 800 of FIG. 7A) at least partially including an electrically conductive material, wherein a surface of the electrically conductive material includes an oxide film layer (e.g., the oxide film layer 800' of FIG. 7A) having a plurality of cavities (e.g., the plurality of cavities 810 of FIG. 7A), wherein the plurality of cavities are colored in a first color (e.g., the first color 831 of FIG. 7A) and a second color (e.g., the second color 832 of FIG. 7A), and wherein the first color and the second color are mixed when the second color is deposited on the first color.

According to an embodiment, coloring in the first color and the second color may be performed by a water-based method of diluting an organic dye with water and depositing the diluted dye.

According to an embodiment, the mixture of the first color and the second color may be formed on an outer wall (e.g., the outer wall 330 of FIG. 4) of the housing facing outward and an inner wall (e.g., the inner wall 320 of FIG. 4) facing in a direction opposite to a direction the outer wall is facing.

According to an embodiment, the housing may further include an insulating material (e.g., the insulating portion 340 of FIG. 4) for dividing the electrically conductive material into at least two portions.

According to an embodiment, fine bumps (e.g., the fine bumps 811 of FIG. 7A) may be formed on the oxide film layer.

According to an embodiment, fine bumps (e.g., the fine bumps 811' of FIG. 7A) may be formed on inner surfaces of the plurality of cavities.

According to an embodiment, the oxide film layer may be colored in the first color via a first coloring process on an oxide film formed by first anodizing, and the oxide film layer may be colored in the second color via a second coloring process performed after partial decoloring is performed on an entire area of the plurality of cavities after the first coloring process.

According to an embodiment, the decoloring may include partially removing a dye deposited in the oxide film layer using an acidic solution.

According to an embodiment, the plurality of cavities may be colored in a mixture of the first color, the second color, and at least one third color deposited on the second color.

According to an embodiment, the oxide film layer may be colored in the first color via a first coloring process on an oxide film formed by first anodizing, the oxide film layer may be colored in the second color via a second coloring process performed after partial decoloring is performed on an entire area of the plurality of cavities after the first coloring, and the oxide film layer may be colored in the at least one third color via a third coloring process performed after partial decoloring is performed on the entire area of the plurality of cavities after the second coloring.

According to an embodiment, there may be provided a method for manufacturing a housing, comprising anodizing to form an oxide film on a surface of a metallic member; first coloring to color an oxide film with a first colorant having a first color; decoloring to remove a portion of the first colorant of the first color from the oxide film; and second coloring to color the oxide film with a second colorant having a second color.

According to an embodiment, the metallic member may include an aluminum alloy.

According to an embodiment, the decoloring may include partially removing the first colorant of the first color on an entire area of a plurality of cavities of the oxide film.

According to an embodiment, the decoloring may include partially removing a dye deposited on the oxide film using an acidic solution.

According to an embodiment, the method may further comprise pre-treating the surface of the metallic member to have a predetermined degree of glossiness and flatness before the anodizing; and sealing for maintaining a performance and characteristic of the first colorant and the second colorant of the colored oxide film after the second coloring.

According to an embodiment, an electronic device may comprise a housing at least partially including an electrically conductive material. A surface of the electrically conductive material may include an oxide film layer having a plurality of cavities and fine bumps. A first color may be formed via first anodizing and first coloring and a second color may be formed via second coloring after partially decoloring the first color using an acidic solution. The first and second colors may be deposited on the plurality of cavities. The first color and the second color may be mixed so as to not have a boundary therebetween. The second color may be formed on fine bumps formed in the plurality of cavities after partial decoloring using the acidic solution.

According to an embodiment, coloring in the first color and the second color may be performed by a water-based method of diluting an organic dye with water and depositing the diluted dye.

According to an embodiment, the mixture of the first color and the second color may be formed on an outer wall of the housing facing outward and an inner wall facing in a direction opposite to a direction the outer wall is facing.

According to an embodiment, the decoloring may include partially removing a dye deposited in the oxide film layer using an acidic solution.

According to an embodiment, the plurality of cavities may be colored in a mixture of the first color, the second color, and at least one third color deposited on the second color.

It is apparent to one of ordinary skill in the art that the electronic device and method for manufacturing the housing of the electronic device according to various embodiments of the disclosure as described above are not limited to the above-described embodiments and those shown in the drawings, and various changes, modifications, or alterations may be made thereto without departing from the scope of the disclosure.

What is claimed is:

1. An electronic device comprising:

a housing at least partially including an electrically conductive material, wherein a surface of the electrically conductive material includes an oxide film layer including a plurality of cavities, wherein each of the plurality of cavities are entirely filled with a first colorant having a first color and a second colorant having a second color different from the first color, and wherein, within each of the plurality of cavities, the second colorant is deposited on the first colorant, wherein the surface of the electrically conductive material has a hardness of 240 to 320 HV (Vickers hardness), an arithmetical mean roughness (Ra) of 0.03 to 0.04 μm, and a maximum height roughness (Rz) of 0.32 to 0.45 μm.

2. The electronic device of claim 1, wherein coloring in the first color and the second color is performed by a water-based method of diluting an organic dye with water and depositing the diluted dye.

3. The electronic device of claim 1, wherein a mixture of the first colorant and the second colorant is formed on an outer wall of the housing facing outward and an inner wall facing in a direction opposite to a direction the outer wall is facing.

4. The electronic device of claim 2, wherein the housing further includes an insulating material for dividing the electrically conductive material into at least two portions.

5. The electronic device of claim 1, wherein fine bumps are formed on the oxide film layer.

6. The electronic device of claim 1, wherein fine bumps are formed on inner surfaces of the plurality of cavities.

7. The electronic device of claim 1, wherein the oxide film layer is colored in the first color via a first coloring process on an oxide film formed by first anodizing, and the oxide film layer is colored in the second color via a second coloring process performed after partial decoloring is performed on an entire area of the plurality of cavities after the first coloring process.

8. The electronic device of claim 7, wherein in the decoloring, the first colorant deposited in the oxide film layer is partially removed using an acidic solution.

9. The electronic device of claim 1, wherein the plurality of cavities are colored in a mixture of the first colorant, the second colorant, and at least one third colorant, having a third color, deposited on the second colorant.

10. The electronic device of claim 9, wherein the oxide film layer is colored in the first color via a first coloring process on an oxide film formed by first anodizing, the oxide film layer is colored in the second color via a second coloring process performed after partial decoloring is performed on an entire area of the plurality of cavities after the first coloring, and the oxide film layer is colored in the third color via a third coloring process performed after partial decoloring is performed on the entire area of the plurality of cavities after the second coloring.

* * * * *